US011728565B2

(12) United States Patent
Su et al.

(10) Patent No.: US 11,728,565 B2
(45) Date of Patent: Aug. 15, 2023

(54) BASE STATION ANTENNA AND BOARD ASSEMBLY FOR BASE STATION ANTENNA

(71) Applicant: CommScope Technologies LLC, Hickory, NC (US)

(72) Inventors: Ruixin Su, Jiangsu (CN); Xun Zhang, Jiangsu (CN); Chengguo Nie, Jiangsu (CN); PuLiang Tang, Jiangsu (CN); Hangsheng Wen, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/513,087

(22) Filed: Oct. 28, 2021

(65) Prior Publication Data

US 2022/0200135 A1 Jun. 23, 2022

(30) Foreign Application Priority Data

Dec. 21, 2020 (CN) ..... 202023099546.7

(51) Int. Cl.
*H01Q 1/22* (2006.01)
*H01Q 1/24* (2006.01)
*H01Q 5/15* (2015.01)

(52) U.S. Cl.
CPC ..... *H01Q 1/246* (2013.01); *H01Q 1/2283* (2013.01); *H01Q 5/15* (2015.01)

(58) Field of Classification Search
CPC .. H01Q 1/38; H01Q 3/46; H01Q 7/00; H01Q 15/14; H01Q 19/10; H01Q 19/18; H01Q 21/26
See application file for complete search history.

(56) References Cited

U.S. PATENT DOCUMENTS

2013/0070819 A1 3/2013 Zhao et al.
2014/0139393 A1 5/2014 Yoon et al.
(Continued)

FOREIGN PATENT DOCUMENTS

CN 107799896 A 3/2018
JP 2013197968 A * 9/2013 ..... H04B 1/38

OTHER PUBLICATIONS

"Extended European Search Report corresponding to European Application No. 21209848.7 dated May 19, 2022".
(Continued)

*Primary Examiner* — Hoang V Nguyen
(74) *Attorney, Agent, or Firm* — Myers Bigel, P.A.

(57) ABSTRACT

The present invention relates to a board assembly used for a base station antenna and a base station antenna including such a board assembly. The board assembly includes a first circuit board (3) and a second circuit board (4), and the first circuit board and the second circuit board are spaced apart from each other. The first circuit board has a plurality of first electrical connectors, the second circuit board has a plurality of second electrical connectors, and the first electrical connectors and the second electrical connectors are electrically connected by a plurality of coaxial cable assemblies (5). Each coaxial cable assembly extends between the first circuit board and the second circuit board, and includes a coaxial cable, a first corresponding electrical connector matching the first electrical connector on a first end of the coaxial cable, and a second corresponding electrical connector matching the second electrical connector on a second end opposite to the first end on the coaxial cable. The board assembly can have stable electrical performance, especially radio frequency signal transmission performance.

18 Claims, 4 Drawing Sheets

(56) References Cited

U.S. PATENT DOCUMENTS

| | | | |
|---|---|---|---|
| 2018/0008363 | A1 | 1/2018 | Moon et al. |
| 2020/0259248 | A1 | 8/2020 | Lv et al. |

OTHER PUBLICATIONS

Adithya, Angampally Hari, et al., "Experimental Evaluation of a Beamforming Array Calibration System", IEEE Aerospace Conference pp. 1-7 (Mar. 3, 2014).

* cited by examiner

BASE STATION ANTENNA AND BOARD ASSEMBLY FOR BASE STATION ANTENNA

RELATED APPLICATION

The present application claims priority from and the benefit of Chinese Utility Model Application No. 202023099546.7, filed Dec. 21, 2020, the disclosure of which is hereby incorporated herein by reference in full.

FIELD OF THE INVENTION

The present invention relates to the technical field of base station antennas, and more specifically, to a board assembly used for a base station antenna and a base station antenna including such a board assembly.

BACKGROUND OF THE INVENTION

A large number of base stations are involved in a mobile communication network, various base stations may comprise base station antennas, and the base station antennas are used to receive and/or transmit radio frequency signals. Therefore, the base station antennas may include arrays of radiators. These radiators are placed on a board assembly. The board assembly may include a reflector, and may include at least one circuit board, such as a feeder panel and a calibration board. The electrical connection between the circuit boards should have stable electrical performance, such as radio frequency signal transmission performance.

SUMMARY OF THE INVENTION

The objective of the present invention is to provide a board assembly used for a base station antenna and a base station antenna including such a board assembly, wherein, the board assembly can have stable electrical performance.

The objective can be achieved by a board assembly used for a base station antenna. The board assembly includes a first circuit board and a second circuit board, the first circuit board and the second circuit board are spaced apart from each other, the first circuit board has a plurality of first electrical connectors, the second circuit board has a plurality of second electrical connectors, the first electrical connectors and the second electrical connectors are electrically connected by a plurality of coaxial cable assemblies, each coaxial cable assembly extends between the first circuit board and the second circuit board, and includes a coaxial cable, a first corresponding electrical connector matching the first electrical connector on a first end of the coaxial cable, and a second corresponding electrical connector matching the second electrical connector on a second end opposite to the first end on the coaxial cable.

The board assembly can achieve small insertion loss of the coaxial cable assembly, and can be insensitive to errors in the assembly of the first circuit board and the second circuit board. In general, good electrical performance, especially radio frequency signal transmission performance, can be achieved.

The space between the circuit boards may be relatively small. In some situations, the circuit boards may be slightly misaligned. The coaxial cable assembly may realize sufficient flexibility advantageously, and ensure a robust electrical performance of the whole board assembly, in particular as compared with the situation of the B2B connectors in the prior art.

In some embodiments, the board assembly may include a reflector, and the first circuit board is mounted on the reflector. The first circuit board may be mounted on a side of the reflector backing on to the second circuit board or on a side of the reflector facing the second circuit board.

In some embodiments, the board assembly may include a support backplate, and the second circuit board is mounted on the support backplate. The second circuit board may be mounted on a side of the support backplate backing on to the first circuit board or on a side of the support backplate facing the first circuit board. The support backplate may be, for example, a frame or a planar element.

In some embodiments, the reflector and the support backplate may be spaced apart from each other by at least one spacer, thus making the first circuit board and the second circuit board spaced apart from each other.

In some embodiments, the board assembly may include at least one (for example, two or more) spacer composed of a metal molded member and/or at least one (for example, two or more) spacer composed of a plastic pillar.

In some embodiments, the board assembly may include an array of radiators, and the radiators extend from the reflector in a direction away from the second circuit board.

In some embodiments, the first electrical connectors and the second electrical connectors, as well as the first corresponding electrical connectors and the second corresponding electrical connectors may be radio frequency connectors.

In some embodiments, the first electrical connectors and the second electrical connectors, as well as the first corresponding electrical connectors and the second corresponding electrical connectors may be respectively arranged in an array.

In some embodiments, the first circuit board may be a feeder panel.

In some embodiments, the second circuit board may be a calibration board.

The objective can also be achieved by a base station antenna, which includes a radome and a board assembly accommodated in the radome, wherein, the board assembly is a board assembly used for a base station antenna according to the present invention.

The various technical features mentioned above, various technical features that will be mentioned below, and technical features that can be obtained from the drawings may be combined arbitrarily as long as the combined individual technical features do not conflict with each other.

BRIEF DESCRIPTION OF THE DRAWINGS

Embodiments of the present invention will be described below with reference to the schematic drawings, in which.

DESCRIPTION OF THE EMBODIMENTS

A board assembly according to an embodiment of the present invention and a base station antenna including the board assembly will be described below with reference to FIG. 1 to FIG. 4. The embodiments shown in FIG. 1 to FIG.

Figure 1:
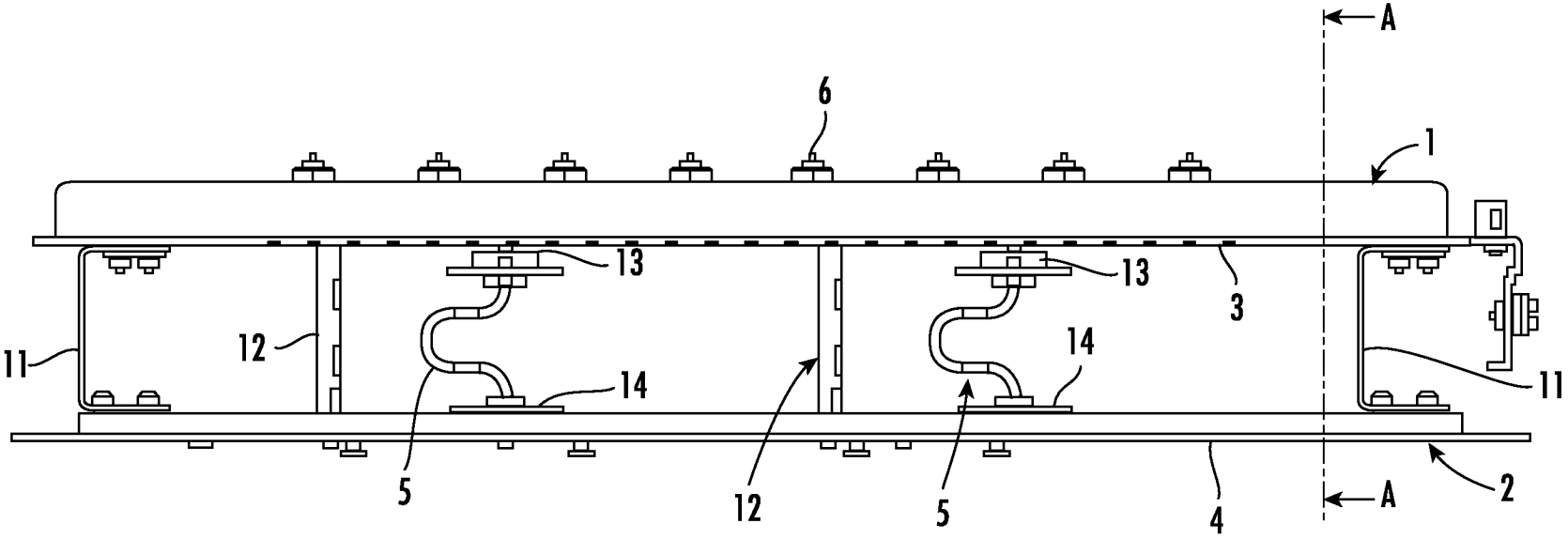
FIG. 1 is a schematic side view of a board assembly according to an embodiment of the present invention.
Figure 2:
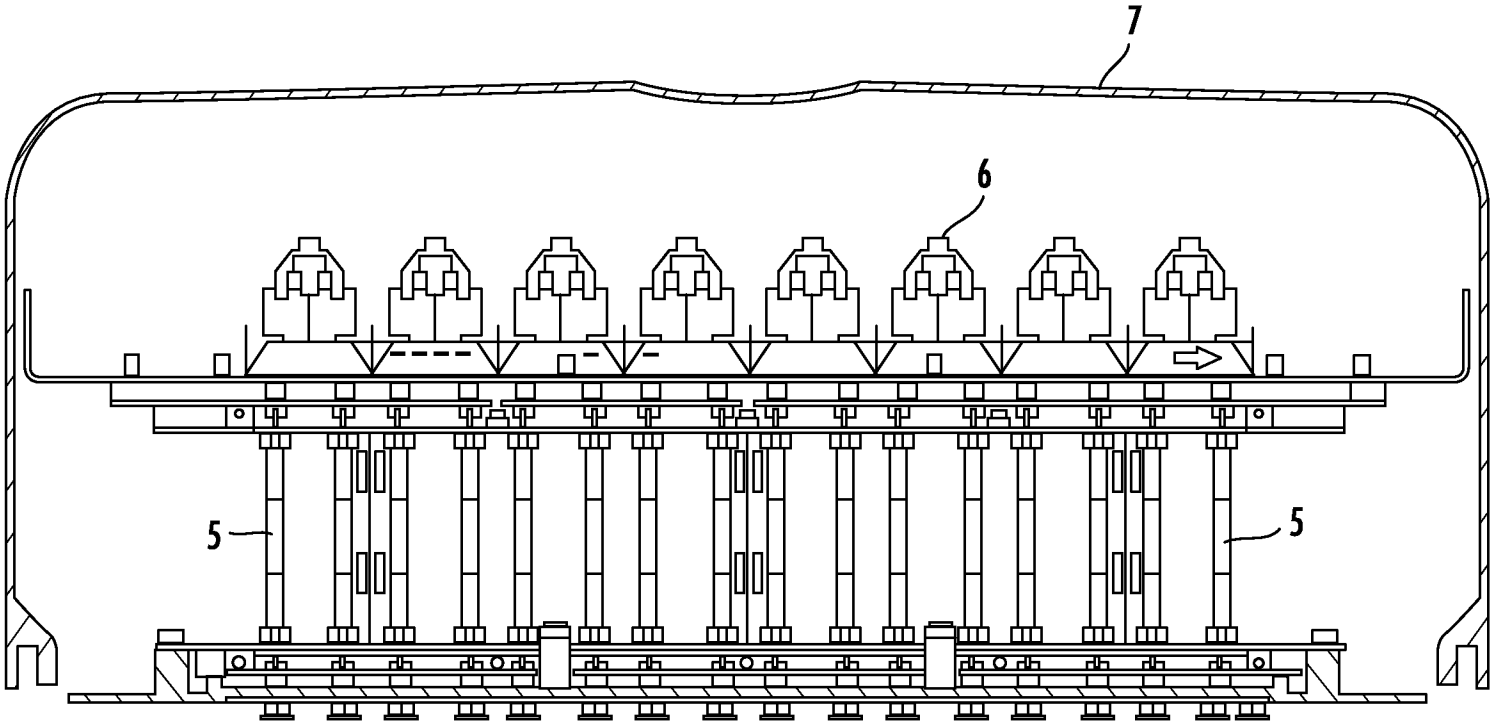
FIG. 2 is a cross-sectional view of the board assembly in FIG. 1 together with a radome taken along the cross-sectional line A-A in FIG. 1.
Figure 3:
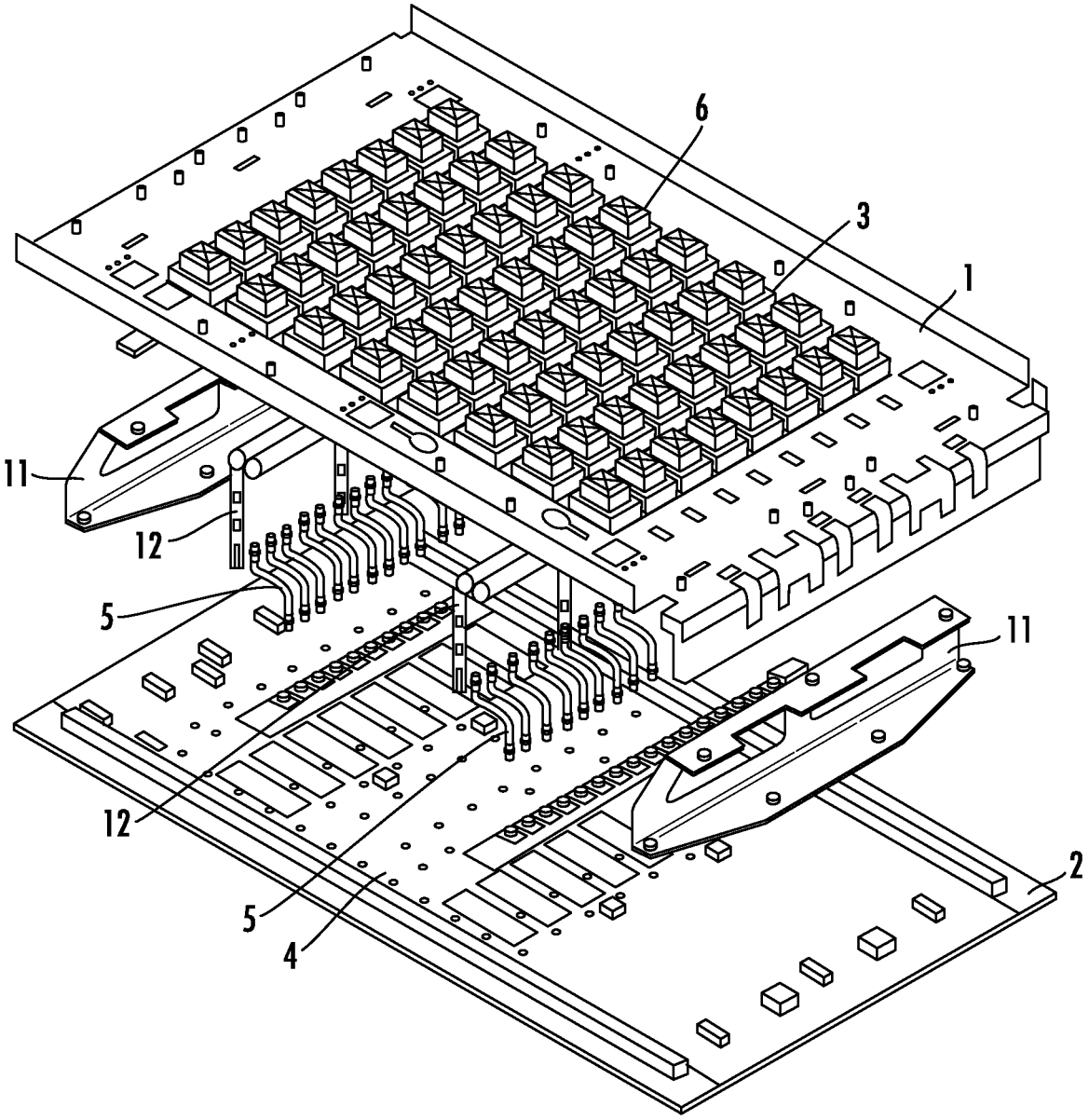
FIG. 3 is an exploded view of the board assembly in FIG. 1.

4 are exemplary and do not limit the protection scope of the present invention. For example, a board assembly to be protected may have only a part of the board assembly as shown in FIG. 1 to FIG. 3. The board assembly may have a roughly rectangular profile. Similarly, the base station antenna may have a roughly rectangular profile.

The board assembly as shown in FIG. 1 to FIG. 3 may include a reflector 1 and a support backplate 2. The reflector 1 may be made of aluminum or an aluminum alloy plate, for example. The support backplate 2 may be configured as a frame made of aluminum or an aluminum alloy plate, for example, or may also be a planar element. The board assembly includes a first circuit board 3 and a second circuit board 4. The first circuit board 3 may be mounted on the reflector 1. The second circuit board 4 may be mounted on the support backplate 2. The first circuit board 3 may be a feeder panel. The second circuit board 4 may be a calibration board.

The reflector 1 and the support backplate 2 may be spaced apart from each other by at least one spacer, thus making the first circuit board 3 and the second circuit board 4 spaced apart from each other. As can be seen from FIG. 1 and FIG. 3, the board assembly may include two spacers composed of metal molded members 11 and two rows of spacers composed of plastic pillars 12, wherein, the two metal molded members 11 are located outside and the two plastic pillars 12 are located inside. The board assembly may include an array of radiators 6, and the radiators 6 extend from the reflector 1 in a direction away from the second circuit board 4.

Figure 4:
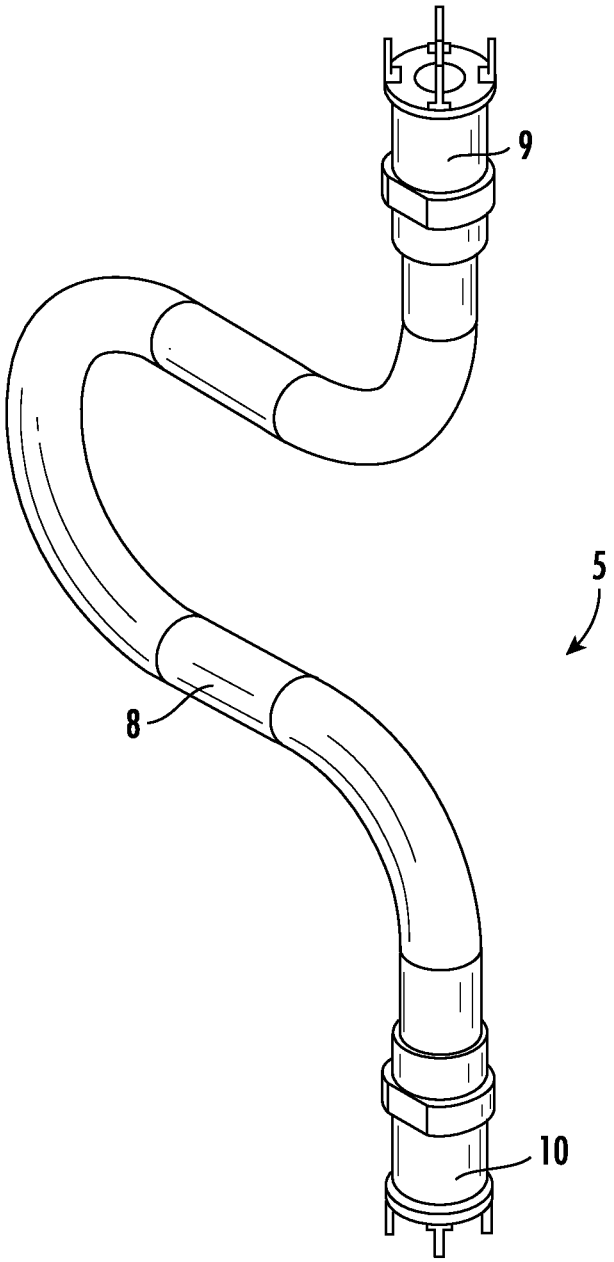
FIG. 4 is a perspective view of a coaxial cable assembly of the board assembly in FIG. 1.

The first circuit board 3 may have a plurality of first electrical connectors 13. The second circuit board 4 may have a plurality of second electrical connectors 14. The first electrical connectors 13 and the second electrical connectors 14 are electrically connected by a plurality of coaxial cable assemblies 5. Each coaxial cable assembly 5 extends between the first circuit board 3 and the second circuit board 4. As shown in FIG. 4, the coaxial cable assembly 5 may include a coaxial cable 8, a first corresponding electrical connector 9 matching the first electrical connector 13 on a first end of the coaxial cable 8, and a second corresponding electrical connector 10 matching the second electrical connector 14 on a second end opposite to the first end on the coaxial cable 8. The first electrical connectors 13 and the second electrical connectors 14, as well as the first corresponding electrical connectors 9 and the second corresponding electrical connectors 10 may be radio frequency connectors. These electrical connectors may be respectively arranged in an array according to the number of these electrical connectors and the space available on corresponding circuit boards. For example, it is possible that the first circuit board may have 2×8, 2×12, or 3×4 first electrical connectors. The number and arrangement of the second electrical connectors as well as the number and arrangement of the coaxial cable assemblies may correspond to the number and arrangement of the first electrical connectors.

In the embodiments shown in FIG. 1 to FIG. 3, the board assembly may include an array of 8×8 radiators 6, two rows of coaxial cable assemblies 5, and two rows of plastic pillars 12. The number of components involved is merely exemplary, and other numbers or different arrangements are also feasible.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between". "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

The invention claimed is:

1. A board assembly used for a base station antenna, the board assembly comprising;

a first circuit board; and a second circuit board, wherein the first circuit board and the second circuit board are spaced apart from and generally parallel with each other, the first circuit board has a plurality of first electrical connectors, the second circuit board has a plurality of second electrical connectors, the plurality of first electrical connectors and the plurality of second electrical connectors are electrically connected by a plurality of coaxial cable assemblies, each coaxial cable assembly extends between the first circuit board and the second circuit board, and includes a coaxial cable, wherein the coaxial cable comprises a third electrical connector on a first end of the coaxial cable matching a corresponding electrical connector of the plurality of first electrical connectors, and a fourth electrical connector on a second end opposite to the first end of the coaxial cable matching a corresponding electrical connector of the plurality of second electrical connectors.

2. The board assembly used for a base station antenna according to claim 1, wherein, the board assembly includes a reflector, and the first circuit board is mounted on the reflector.

3. The board assembly used for a base station antenna according to claim 1, wherein, the board assembly includes a support backplate, and the second circuit board is mounted on the support backplate.

4. The board assembly used for a base station antenna according to claim 2, wherein the board assembly includes a support backplate, the second circuit board is mounted on the support backplate, and the reflector and the support backplate are spaced apart from each other by at least one spacer, thus making the first circuit board and the second circuit board spaced apart from each other.

5. The board assembly used for a base station antenna according to claim 4, wherein the board assembly includes at least one spacer composed of a metal molded member and/or at least one spacer comprising a plastic pillar.

6. The board assembly used for a base station antenna according to claim 2, wherein the board assembly includes an array of radiators, and the radiators extend from the reflector in a direction away from the second circuit board.

7. The board assembly used for a base station antenna according to claim 1, wherein the plurality of first electrical connectors and the plurality of second electrical connectors, as well as the third electrical connector and the fourth electrical connector of each coaxial cable are radio frequency connectors.

8. The board assembly used for a base station antenna according to claim 1, wherein the plurality of first electrical connectors and the plurality of second electrical connectors, as well as the third electrical connector and the fourth electrical connector of each coaxial cable are respectively arranged in an array.

9. The board assembly used for a base station antenna according to claim 1, wherein the first circuit board is a feeder panel, and the second circuit board is a calibration board.

10. A base station antenna, including a radome and a board assembly as defined in claim 1 housed in the radome.

11. A board assembly for a base station antenna, comprising:

first and second circuit boards spaced apart from and generally parallel with each other;

a plurality of first electrical connectors mounted on the first circuit board;

a plurality of second electrical connectors mounted on the second circuit board;

a plurality of coaxial cable assemblies, each coaxial cable assembly including a coaxial cable, a third electrical connector on a first end of the coaxial connector and mating with a respective one of the plurality of first electrical connectors, and a fourth electrical connector on a second end opposite to the first end on the coaxial cable mating with a respective one of the plurality of second electrical connectors.

12. The board assembly according to claim 11, further comprising a reflector, wherein the first circuit board is mounted on the reflector.

13. The board assembly according to claim 11, further comprising a support backplate, wherein the second circuit board is mounted on the support backplate.

14. The board assembly used for a base station antenna according to claim 12, further comprising an array of radiators mounted on the reflector, wherein the radiators extend from the reflector in a direction away from the second circuit board.

15. A base station antenna, comprising:

a radome; and a board assembly housed in the radome, the board assembly comprising:

first and second circuit boards spaced apart from and generally parallel with each other;

a plurality of first electrical connectors mounted on the first circuit board;

a plurality of second electrical connectors mounted on the second circuit board;

a plurality of coaxial cable assemblies, each coaxial cable assembly including a coaxial cable, a third electrical connector on a first end of the coaxial connector and mating with a respective one of the plurality of first electrical connectors, and a fourth electrical connector on a second end opposite to the first end on the coaxial cable and mating with a respective one of the plurality of second electrical connectors.

16. The board assembly according to claim 15, further comprising a reflector, wherein the first circuit board is mounted on the reflector.

17. The board assembly according to claim 16, further comprising a support backplate, wherein the second circuit board is mounted on the support backplate.

18. The board assembly according to claim 17, further comprising an array of radiators mounted on the reflector, wherein the radiators extend from the reflector in a direction away from the second circuit board.

* * * * *